US005980224A

United States Patent [19]

Regueiro

[11] Patent Number: 5,980,224

[45] Date of Patent: Nov. 9, 1999

[54] FUEL INJECTION PUMP

[75] Inventor: Jose F. Regueiro, Rochester Hills, Mich.

[73] Assignee: Chrysler Corporation, Auburn Hills, Mich.

[21] Appl. No.: 08/993,413

[22] Filed: Dec. 18, 1997

[51] Int. Cl.[6] ..... F04B 39/10

[52] U.S. Cl. ..... 417/569; 137/539.5

[58] Field of Search ..... 417/569, 570; 137/539.5

[56] References Cited

U.S. PATENT DOCUMENTS

| | | | |
|---|---|---|---|
| 4,076,043 | 2/1978 | Rogan | 137/539.5 |
| 4,474,208 | 10/1984 | Looney | 137/516.29 |
| 5,141,025 | 8/1992 | Eichorn et al. | 137/539.5 |
| 5,293,897 | 3/1994 | Warga et al. | 137/493.3 |
| 5,626,325 | 5/1997 | Bucanan et al. | 251/129.14 |
| 5,848,880 | 12/1998 | Helmig | 417/560 |

*Primary Examiner*—Timothy S. Thorpe
*Assistant Examiner*—Ehud Gartenberg
*Attorney, Agent, or Firm*—Kenneth H. Maclean

[57] ABSTRACT

An improved delivery valve for a plunger type fuel distribution pump characterized by ease of manufacture, lightness, and enhance performance in achieving both a check valve function and a retraction volume function. Specifically, previous machined constructions utilized a conically configured check valve and machined grooves which in the improved design are replaced by a commercially available high-precision, smoothly finished steel bearing ball element and by lightweight, tubular stem design.

6 Claims, 4 Drawing Sheets

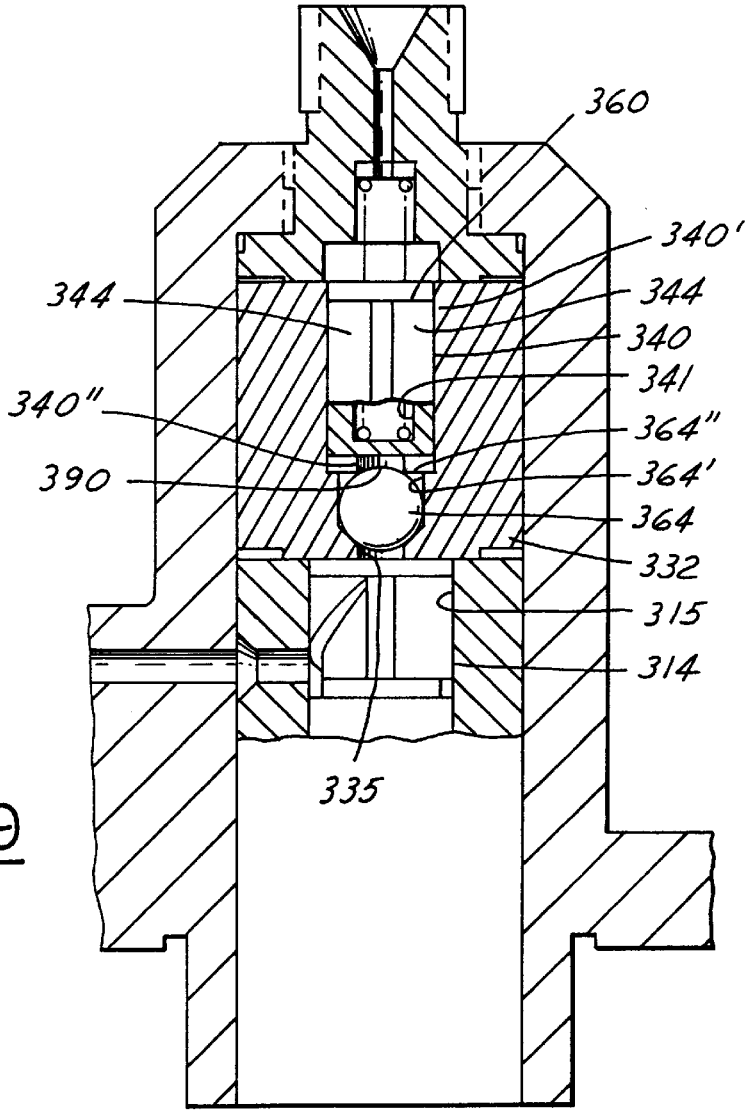
FIG. 9
FIG. 10
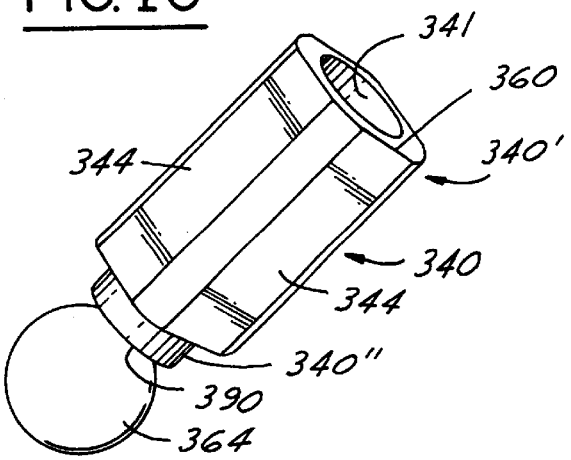
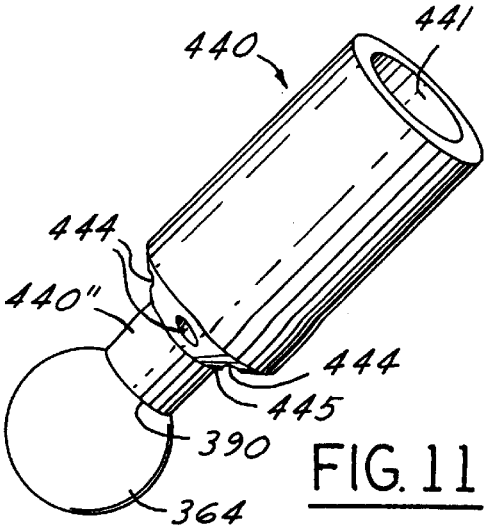
FIG. 11

FUEL INJECTION PUMP

FIELD OF THE INVENTION

This application concerns a fuel control component in a fuel injection system for an internal combustion engine, and more particularly, a flow control or delivery portion of a plunger type fuel pump.

BACKGROUND OF THE INVENTION

This invention concerns fuel injection for a vehicle engine particularly a pump-line-nozzle type system and pump which are commonly used with diesel engines. Such a pump commonly utilizes a delivery valve having a backflow prevention valve element and a pressure relief element for the fuel line leading to the fuel injector. In a preferred embodiment, the delivery valve device is positioned downstream of the pump's internal pumping components and upstream of each outlet leading to the high-pressure lines which are connected to individual fuel injectors for each cylinder of the engine. Each of the high-pressure lines supplies pressurized fuel to a fuel injector associated with a cylinder and combustion chamber. In response to an increase in fuel pressure to a set pressure level, the fuel injector is opened for spraying fuel into an associated combustion chamber. Correspondingly, when the pressure level decreases to a certain level, the fuel injector closes.

Typically in such systems, a provision is made to prevent backflow of fuel from the lines to the pump. Also, provision is made to slightly relieve fuel pressure in the line by a "delivery" valve so as to prevent "dribble" injection through the injector. The delivery valve defines a "retraction volume" to slightly relieve the line pressure. Thus, the delivery valve has two important functions: first, it prevents fuel backflow via a check valve or the like; and second, it provides a pressure reducing function for fuel upstream of the fuel injector by means of providing a "retraction volume" mechanism located upstream of the pumping elements. Backflow prevention is important because it desirably traps pressurized fuel in a high-pressure line leading to the fuel injector so the line never empties but yet retains a pressure level high enough to prevent the hot fuel from boiling in it. The line pressure reduction quickly reduces fuel pressure upstream of the fuel injector at the close of the injection cycle to prevent dribble of fuel from passing the injector and entering the combustion chamber.

The backflow prevention function is important to conserve system energy by maintaining a relatively high fuel pressure in the fuel lines downstream of the fuel injector prior to an injection cycle for a particular cylinder. Accordingly, when the injection cycle is initiated at the next injection cycle, the fuel pressure need only be slightly increased to a level exceeding the injector's set opening characteristic. Naturally, the backflow prevention traps pressurized fuel in the line leading to the injector and conserves energy for the next injection cycle but also increases the responsiveness of the injection system and allows use of a smaller capacity fuel pump. Another advantage is the elimination of creation of a low pressure or vacuum conditions in the fuel line which can result from an instantaneous reversal of the fuel flow. In addition, line-cavitation is prevented which tends to harm a fuel line by internal erosion creating debris arising from the erosion. This debris can damage the fuel injector's nozzle tip which has very small and high-precision clearances therein.

The delivery valve's second pressure relief function for the high pressure fuel line is important to more precisely control both the quantity and the timing of fuel injection to a combustion chamber. While it was previously noted that maintenance of fuel pressure in the line is desirable, the pressure level maintained in the line should be at a level insufficient to cause any significant fuel flow past the injector's valve. Specifically, at the end of a designated injection period, the fuel's pressure level in the high-pressure line can be above the designed opening pressure level of the fuel injector. This pressure level can undesirably allow a small quantity of fuel to flow past the injector and into the combustion chamber. The undesirable additional injection of fuel may continue until the pressure level falls below the closing characteristic or criteria of the particular fuel injector. This condition, known as after-injection, post-injection, or "dribble", introduces a quantity of fuel in excess of the ideal quantity and also the dribble flow occurs at a continuously-decreasing pressure usually resulting in very poor fuel atomization. The usual result is a formation of relatively large fuel droplets that do not have any appreciable energy and enter the cylinder or combustion chamber late in the engine's combustion cycle. The large droplets do not atomize and evaporate completely and the fuel is not efficient in associating and combining with oxygen. Typically, the fuel droplets barely pyrolyze and all too often exit the combustion chamber as smoke. Accordingly, this condition produces high soot emissions and limit the power potential of the engine.

The above mentioned pressure relief function of the delivery valve enhances fuel injector performance for precisely cutting-off injection of fuel at the desired time of the engine's cycle. This prevention of post-injection is achieved by artificially creating additional volume communicated to the line to slightly lower line pressure at a precise time that the injection cycle is supposed to cease. This additional line volume is called a "retraction volume". Pressurized fuel is allowed to expand into the retraction volume to relieve line fuel pressure to a level below that of the closing characteristic of the injector. In this fashion, after-injections are precluded and precise cut-off of injection at the nozzle are achieved which results in clean exhaust with an absence of smoke or soot. This not only reduces emissions, but, by cleaning the exhaust of visible smoke, permits more powerful operation of the engine so as to handle greater loads. Consequently, the mechanical efficiency of the engine is increased and the specific fuel consumption is decreased.

As with any liquid fuel system, it is necessary to keep fuel in a liquid state rather than a vapor state in order to maintain the hydraulic integrity of the system. Thus, in all cases, the "retraction volume" of the delivery mechanism is carefully designed and controlled to maintain line pressure at a high enough level to prevent fuel within the line from boiling due to the high-temperature environment surrounding the fuel system; and/or from getting into a vacuum condition, and cavitating caused by dynamic pressure spikes within the system.

The previously discussed delivery valve is used with and is a part of an injector pump of a known plunger-and-barrel type. Typically, such a pump receives periodic mechanical engine timed inputs through a camshaft and tappets. In such a pump, the basic elements of the pump assembly are typically disposed vertically and extend upward from the engine camshaft and tappets in the following order: plungers which are axially movable in a stationary barrel assembly which are activated by the camshaft and tappets; the delivery valve assembly; and outlets and high pressure lines leading to fuel injectors, one located at each of the engine's cylinders and combustion chambers. Activation of the plungers by the camshaft and tappets moves the plunger upward which pressurizes and pumps fuel. The fuel flows past the delivery valve before passing through an outlet fitting and into a high-pressure line. The fuel flows to a fuel injector which is opened in response to a fuel pressure level above a set opening pressure level characteristic for the injector.

Typically, a delivery valve has two basic parts: a housing with a cylinder bore formed therein; and a small movable member also called the stem member reciprocal in the housing. The stem's outside dimension or surface is closely fitted in the cylinder bore and is moveable therein in response to the pressure of fuel and a force exerted by a spring. The stem's outside surface is typically fluted which provides a close tolerance but low-friction sliding relationship with the cylindrical bore. The flutes also allow fuel to pass between the end portions of the stem as well as acting as guides while minimizing contact between the stem and the housing. A retraction volume mechanism is located at an upper end portion of the stem and a check-valve is located at either end portions of the stem. Specifically, the retraction volume chamber or cavity is formed between the stem and the housing by creation of a retraction-volume land, or control-surface on the stem and forming an adjacent groove in the stem. In an axial direction of the stem, the retraction-volume land typically has a small height dimension, typically only about 1 mm.

In a typical construction using a top-end type check valve, the stem has a conically shaped neck formed just downstream (above)the retraction volume land portion. The neck portion has a larger diameter than the end of the adjacent cylinder bore in the housing and the upper edge of the cylinder bore serves as a seat for the conically shaped portion. The seating relationship closes the delivery valve to prevent a backflow of fuel to the pump interior during the non-injection or dwell period for that particular cylinder. The closing of the delivery valve by engagement of the conically shaped portion and the seat is aided by operation of gravity on the stem portion as well as a downward force produced by a light return spring.

In operation of the pump, the pumping chamber located above the plunger is first filled with fuel allowed by positioning of the top edge portion of the plunger below the lower edge of the fuel feed-hole or inlet. Then upward movement of the plunger by the input from the engine's cam and tappet moves the top edge past the inlet to block flow out of the pumping chamber. Increased pressure of fuel in the pumping chamber lifts the stem and its check valve from a seat against the biasing force of the stem re turn spring. With additional plunger movement, fuel trapped in the pumping chamber passes to the lower part of the delivery valve through the fluted configuration but cannot yet pass into the line to the fuel injector until the lower control edge of the retraction-volume land clears the top edge of the delivery valve housing. Then fuel is passed into the line to the fuel injector until the lower helical control curface of the stem registers with and passes the lower edge of the fuel feed-hole or inlet at which time pressurized fuel is relieved into the inlet. At this point, pumping action ceases as the pressure in the pumping chamber, attaining a maximum of 20,000 psi in some cases, instantly drops to the fuel inlet pressure which is typically about 35–50 psi.

When the above described spilling of pressure back into the inlet feed-hole occurs, the fuel pressure in the line would remain high and continue to flow through the injector nozzle which is set to open at a pressure of 1500–3500 psi. This flow would continue until the line pressure was reduced to below the injector opening pressure. A certain volume of fuel must be accomodated to relieve this high line pressure so that the fuel injection through the nozzle stops when the pump pressurization ceases. The volume to be relived is a function of the line pressure, the length of the line, the internal and external diameter of the line, and the spring chamber volume at the bottom of the oulet fitting. For a typical large truck engine, this volume could be about 70–80 cubic mm. For a smaller four cylinder automobile engine, the volume could be about 30–35 cubic mm.

The retraction volume of the delivery valve provides a space or volume for receiving the necessary quantity of fuel to relieve the high line pressure to prevent flow after the end of the pumping cycle. This pressure relief prevents formation of smoke and soot caused by injection of excess fuel late in the combustion process. The retraction volume is created as the delivery valve stem moves downward and its lower control edge formed by the retraction-volume land passes by the upper edge of the delivery valve housing. The continues to form as the stem continues its downward movement until the conically shaped check valve seats in a closed position. Thus, a space is created by downward displacement of the retraction-volume land past the upper control edge of the delivery valve housing. This fuel "retracted" is not lost back to the pump but remains in the delivery system ready to be part of the fuel pressurized and pumped in the next injection cycle. In this way, it is possible to affect a sharp and clean cut-off of fuel injected at the nozzle without additional "dribble" of excess fuel and while still maintaining a certain residual level of fuel pressure in the line. The residual pressure is set to be high enough to avoid line cavitation and/or boiling (evaporation) of fuel. Also, the residual pressure is set to be sufficiently low enough so that natural pressure spikes that occur under dynamic pressure conditions do not reach a level sufficiant to instantaneously crack the injector nozzle open.

In practice, it is desirable to minimize the line volume as well as the volume in the delivery valve's return spring cavity as this reduces the necessary sizing requirement for the retraction volume as much as possible. Reducing the necessary retraction volume resultantly reduces travel requirements of the retraction-volume land. All of the above help to: increase the responsiveness; decrease the closing impact characteristics. overall, this increases the sealing integrity and the durability of the system.

In the second popular valve design, the conical check valve is positioned at the bottom of the stem and the retraction-volume land at the top portion of the stem. This permits a hollow central portion of the stem for receiving a large portion of the stem return spring. This allows a shorter spring retaining volume at its upper end portion which allows the vertical dimension of the assembly to be shortened. This promotes a lighter valve design which requires less material and less machining resulting in a more compact, lower weight pump assembly.

The movement of the pump's plunger is produced by input from a lobe of a camshaft. Specifically, a tappet is acted upon by the cam lobe to first cause upward movement of the plunger. This movement first causes a closing of an inlet feed-hole formed in the pump barrel. This feed hole is in fluid communication with the discharge portion of the fuel supply system. Thereafter, further upward movement of the plunger pressurizes fuel. The pressure of the fuel lifts the conical check valve off its seat against the force of the return spring and gravity. With additional upward movement of the plunger, fuel in the pumping chamber is displaced through the lower fluted part of the delivery valve but cannot pass into the discharge line until the stem is moved so that the lower control edge of the retraction-volume land clears the top edge of the delivery-valve housing. Depending on the diameter of the retraction-volume land, and the amount and pressure of the fuel being pumped, the lower control edge of the retraction-volume land is moved past the upper control-edge of the delivery-valve housing by a finite distance. The stem remains in this delivery position during the injection period until the period ends as the plunger "spills" (discharged). Fuel is "spilled" as a lower helical control surface of the plunger registers with, and then surpasses, the lower edge of the feed hole in the barrel.

Also, in the second design, the flutes are replaced by flats machined on the sides of the stem. In the second prior art embodiment, the smaller conical section at the lower portion is smaller and this saves considerable machining and material, thus reducing cost. Since different sections consume axial space of the stem, valves with many changes in machined sections, such as the first example, are axially longer than otherwise which forces the valve housing also to be longer-than-needed. This in turn also requires a longer (taller) pump housing and results in a heavier, taller, costlier pump.

What is needed is a lower, lighter, smaller valve design which requires less material and machining, and results in a lower-cost, shorter (in height), lighter pump, which also allows more installation flexibility and a better line-layout.

SUMMARY OF THE INVENTION

Accordingly, the embodiments of this application offer simpler, lighter, and lower-cost delivery valve designs which lends itself to a simpler, lighter, smaller, and lower-cost injection pump with a generally lower height dimension.

More specifically, the present improved delivery valve reduces material requirements and reduces machining required to form the important delivery valve stem. Specifically, the check valve portion of the delivery valve is improved by replacing the machined conically configured section with a high-precision, smoothly finished steel ball element as are readily available from the ball bearing industry. As these ball elements are manufactured in extremely high volumes, they offer a high quality and low cost source for the basic check valve part.

A further object of the present invention is to use the ball to perform a dual function: first as a check-valve; and secondly for creating and controlling a retraction-volume as required by differing fuel injection systems.

A still further object of the present invention is to provide a delivery valve stem with a single function which is to guide the ball element, and therefore it can be made simpler, lighter, and cheaper.

Other objects, advantages, and features of the present invention will become apparent from the following detailed description of the invention when considered in conjunction with the following drawings.

BRIEF DESCRIPTION OF THE DRAWINGS

FIG. 9 is an elevational sectioned view of a second embodiment of the subject delivery valve in accordance with the present invention; and, FIG. 10 is a perspective view of the valve stem shown in FIG. 9; and FIG. 11 is a perspective view of another embodiment of the valve stem element for performing the same function as the elements shown in FIGS. 9 and 10.

DETAILED DESCRIPTION OF THE DRAWINGS

A Prior Art Pump and Delivery Valve

Figure 1:
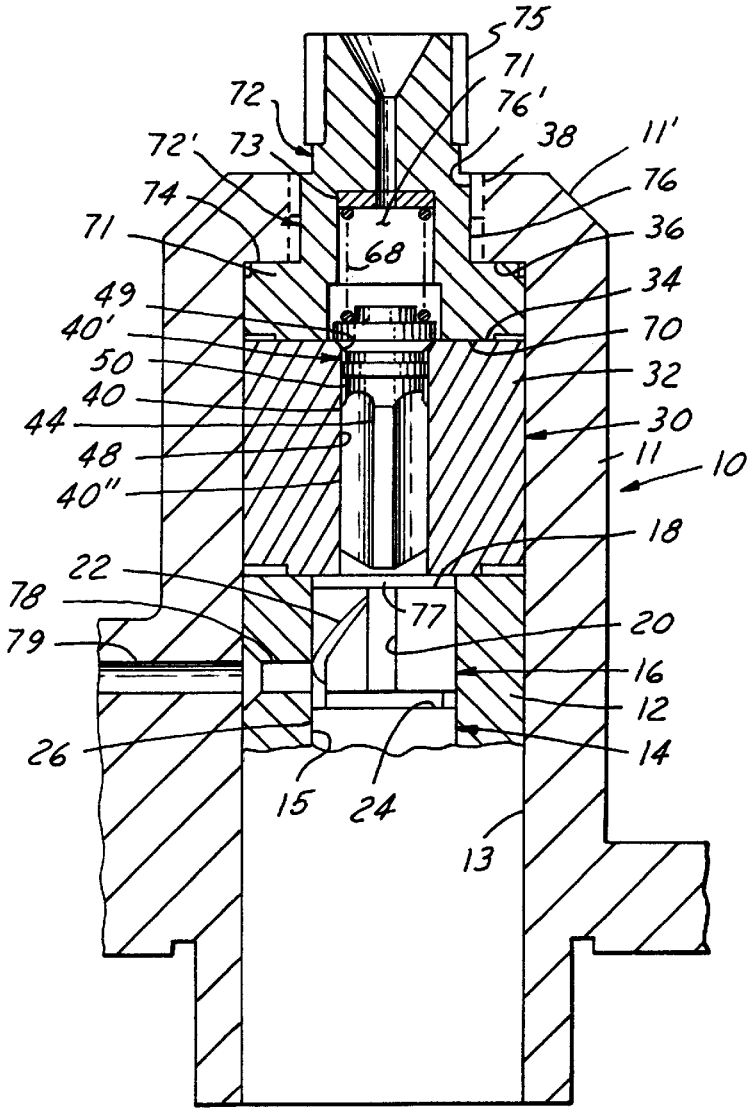
FIG. 1 (PRIOR ART)
FIG. 1 is a elevational sectioned view of a prior art plunger-and-barrel pump assembly with a delivery valve having a retraction volume configuration.
Figure 2:
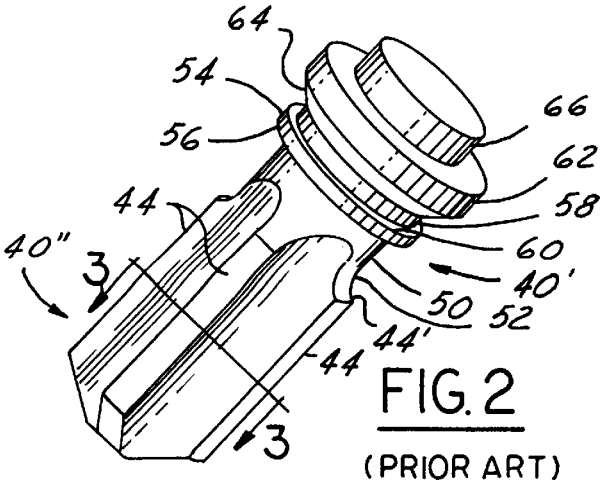
FIG. 2 (PRIOR ART)
FIG. 2 is a perspective view of the prior art stem valve member of the delivery valve shown in FIG. 1.

Referring now to the drawings and more particularly to FIGS. 1 and 2 thereof, a prior-art injection pump assembly is illustrated. The pump assembly 10 is a plunger-and-barrel type having a pump casing or housing 11. A barrel member 12 is secured in an internal bore 13 of housing 11. The plunger member 14 is supported for reciprocal movement in a bore 15 formed in the barrel member 12. An upper portion 16 of the plunger 14 carries a control surface 18, a vertically extending groove 20, a helix configured edge 22, and a lower circumferentially extending groove 24. A guide-extension portion 26 of the plunger is located below groove 24 and is acted on by a plunger-return spring and camshaft activated tappet (neither shown) which are located below the plunger assembly 14 to normally position the plunger assembly. The camshaft activated tappet causes up-and-down reciprocal movement of the plunger in its bore when the associated engine is operating so as to pump fuel for subsequent injection into an engine cylinder and combustion chamber. As is known in the engine art, the fuel pump's camshaft is driven at half the engine crankshaft speed for a four-cycle engine.

A delivery valve 30 is disposed above the barrel 12 and plunger 14 including a housing 32 which is supported in the pump casing 11. Housing 32 is positioned so that its upper surface 34 abuts a lower surface 70 of an outlet fitting 72. A shoulder portion 74 of the outlet fitting seats against a downwardly facing, internal shoulder 36 of a reduced diameter upper portion 38 of the pump casing 10. The outlet fitting 72 is secured against rotation in the reduced diameter portion 38 by axial male splines 76 formed in the outlet fitting 72 which mate with female splines 76' formed in the upper portion 11' of the pump casing 11.

Figure 3:
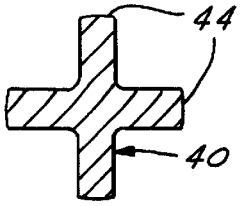
FIG. 3 (PRIOR ART)
FIG. 3 is a cross-sectional view taken along line 3'—3' of FIG. 2.

The delivery valve 30 has a stem member 40 disposed in housing 32 to permit reciprocal movements in an axial up and down direction. As best seen in FIGS. 2 and 3, straight flutes 44 are formed in a lower end portion 40" of the stem. The flutes 44 contact the walls of the bore and guide the stem in its reciprocal movements. They also permit a close fitting relationship and reduce friction with bore 48. A circular groove 50 is formed in the upper portion 40' of the valve stem 40 which defines a lower edge 52 (also the top edge 44' of the flutes 44). An annular retraction-volume control land 54 is formed above circular groove 50 and defines a lower control edge 56. A second circular groove 58 is formed above an upper edge 60 of the retraction-volume control land 54. A conically configured portion 64 and a cylindrical portion 62 are formed above the second groove 58. A smaller diameter portion 66 is located above the cylindrical portion 62 whose function is to secure a lower end of a return spring 68.

As can be understood from the drawing of the stem, a considerable amount of machining is required to form the stem configuration and much material must be removed. Remaining stem material attributes a great deal of weight to the stem. The effective retraction volume for this type of valve is related to the diameter of its retraction-control land 54 as well as the distance between its lower control edge 56 and the point of the same diameter where conical surface 64 seats against the thin seat 49 formed at the top of the inside diameter 48 of the delivery-valve housing 32 which eventually blocks fuel flow.

When the stem 40 is moved upward to deliver fuel to the line and associated fuel injector, its upper portion including its portions with diameters 62, 66, as well as return spring 68 must fit entirely within a cavity or space 71 formed in the lower portion 72' of the outlet fitting 72. This cavity 71 has a large volume, which in addition to the volume of the associated line, must be accommodated by the retraction volume in rapidly reducing line pressure after the desired injection period ends. Further, this arrangement requires a substantial travel distance equal to the distance between the lower control-edge 56 and the conical portion 64. The long travel distance in turn requires a longer return spring 68 and the additional length and dead volume of cavity 71 to accommodate the elements. These factors are all detrimental to an optimum dynamic operation of the hydraulic pumping and delivery system.

With the type of delivery valve described above, the distance between the lower control-edge 56 and the conical seat 64 or the travel distance is varied to accommodate differing retraction volume requirements for different engines. The distance is made longer for a greater retraction volume, and made shorter for a lesser volume.

Further, a hardened washer 73 is necessary to provide a removable seating surface for the spring 68. Also, a threaded outlet fitting 75 where the high-pressure line is attached to the high-pressure line. In addition, a bore or feed hole 78 in pump barrel 12 inputs fuel from an inlet passage 79 in the pump housing 10. Control of the injected quantity of fuel is provided by a rack and piston system (not shown) which rotates the plunger so as to change the distance traveled by the plunger in its upward pumping stroke between the upper control surface 18 and the helix edge 22, which determines the spill timing, as both surfaces register with either the upper or lower control edges of feed hole 78. The longer the distance, the larger the quantity of fuel injected. Engine stop is provided by rotating the plunger to the point where the vertically extending groove 20 is in a continuous register with the feed hole 78. In this case, the pumping ceases.

A Second Prior Art Pump and Delivery Valve

Figure 4:
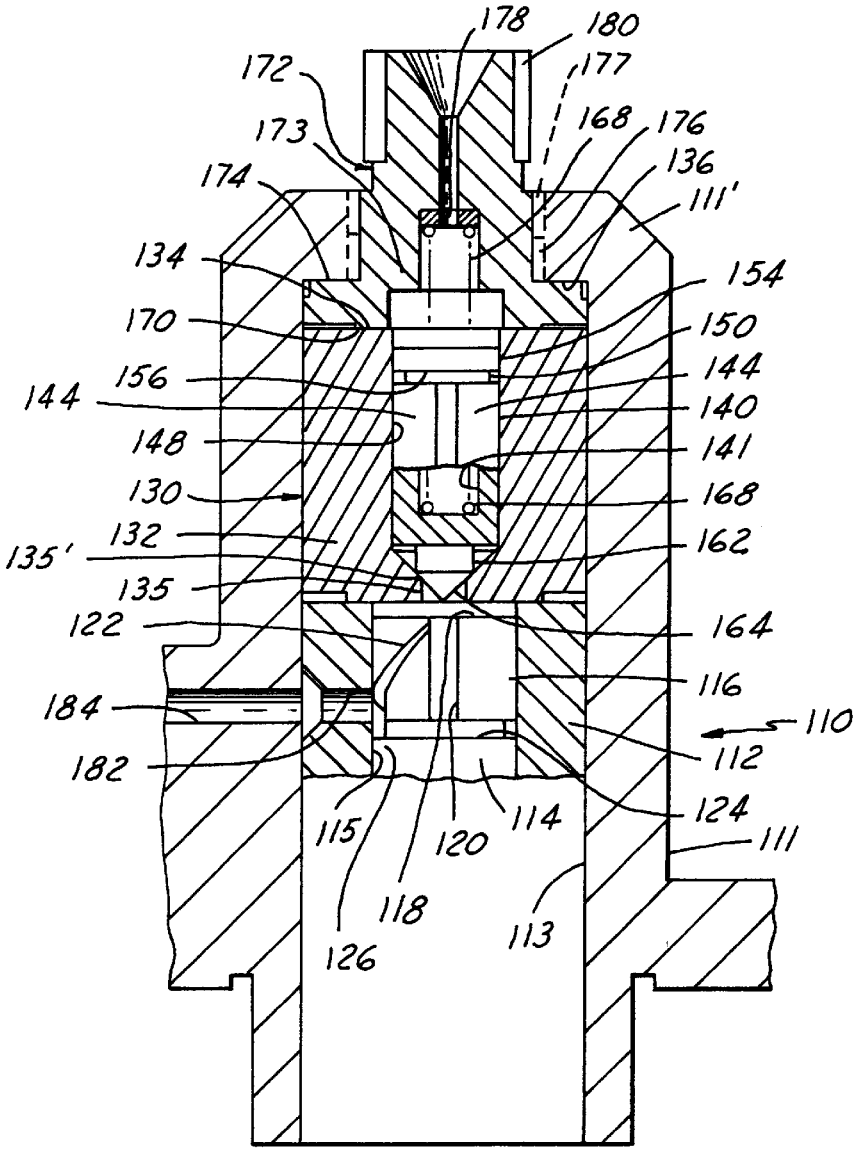
FIG. 4 (PRIOR ART)
FIG. 4 is an elevational sectioned view of a prior art plunger-and-barrel pump assembly with another design of delivery-valve with retraction volume.
Figure 5:
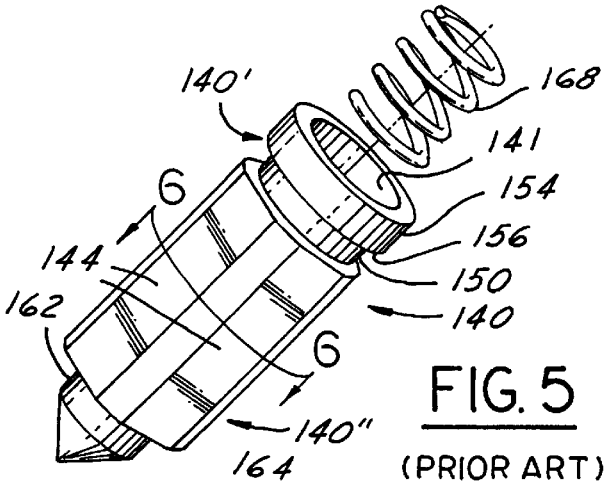
FIG. 5 (PRIOR ART)
FIG. 5 is a perspective view of the valve stem shown in FIG. 4.
Figure 6:
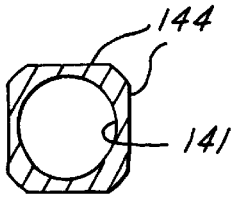
FIG. 6 (PRIOR ART)
FIG. 6 is a cross-sectional view taken along line 6'—6' in FIG. 5.

In FIGS. 4, 5 and 6, a second prior-art injector pump and delivery valve is shown. Since there are many identical or similar components of the pumps and delivery valves shown in the two prior art embodiments of FIGS. 1–3 and of FIGS. 4–6, the previous description is referenced. The assembly includes a pump housing or casing 110 which has a barrel member 112 therein. The plunger 114 is supported for reciprocal movement in the bore 115 of the barrel member 112. The upper portion 116 of the plunger 114 is identical to the previous embodiment and includes: control surface 118; axially extending groove 120; helically extending control edge 122; circular groove 124; and the guide extension portion 126 of the plunger.

A delivery valve assembly 130 including a housing 132 is supported within pump housing 110 above barrel member 112. An upper end or surface 134 of the delivery valve ho using 132 is seated against a shoulder surface 170 formed in a lower portion of an outlet fitting 172. Adjacent a reduced diameter portion 173, the outlet fitting 172 has a shoulder 174 seated against a bottom edge portion or shoulder 136 of the housing 111. The outlet fitting 172 is secured against rotation in the pump housing by interaction between splines 176 formed in the outlet fitting 172 and splines 177 formed in the upper portion 111' of the pump casing 111.

As best seen in FIG. 5, the delivery valve housing 132 supports an elongated stem valve member 140 in a bore 148. The stem valve member 140 has upper and lower portions 140' and 140" respectively. The stem 140 of the delivery valve is generally tubular and has a hollow central bore 141 axially extending through most of its length. The hollow construction reduces weight of the stem and also houses much of return spring 168.

Instead of a fluted surface as in FIGS. 1–3, a plurality of milled flat portions 144 are provide as best shown in FIGS. 5 and 6. A single circumferentially extending groove 150 is formed in the upper end portion 140' of stem 140 thereby defining a lower control edge portion 156 of a cylindrical retraction-volume land 154 thereabove. The bottom portion 140" of stem 140 is reduced or necked-down to form a smaller diameter portion 162. A conically configured end portion 164 is formed below the smaller diameter portion 190 and acts as a check valve when seated against an edge seat 135' defined by an apertured lower end portion 135 of the delivery valve housing 132.

At the termination of the injection period, the conically shaped portion 164 moves against the edge seat 135' to prevent reverse flow (downward) of fuel back into the pump. When the conical valve 164 is seated in its closed operative position, as shown in FIG. 4, the effective retraction volume is related to the diameter of its retraction-control land 154 as well as the distance between its lower control edge 156 and the top surface 134 of the delivery valve housing 132.

Further, a hardened washer 178 is necessary to provide a removable seating surface for the spring 168. Also, a threaded outlet fitting 180 where the high-pressure line is attached to the high-pressure line is shown. In addition, a bore or feed hole 182 in pump barrel 12 inputs fuel from an inlet passage 184 in the pump housing 10.

An Improved Fuel Injection Delivery Valve

Figure 7:
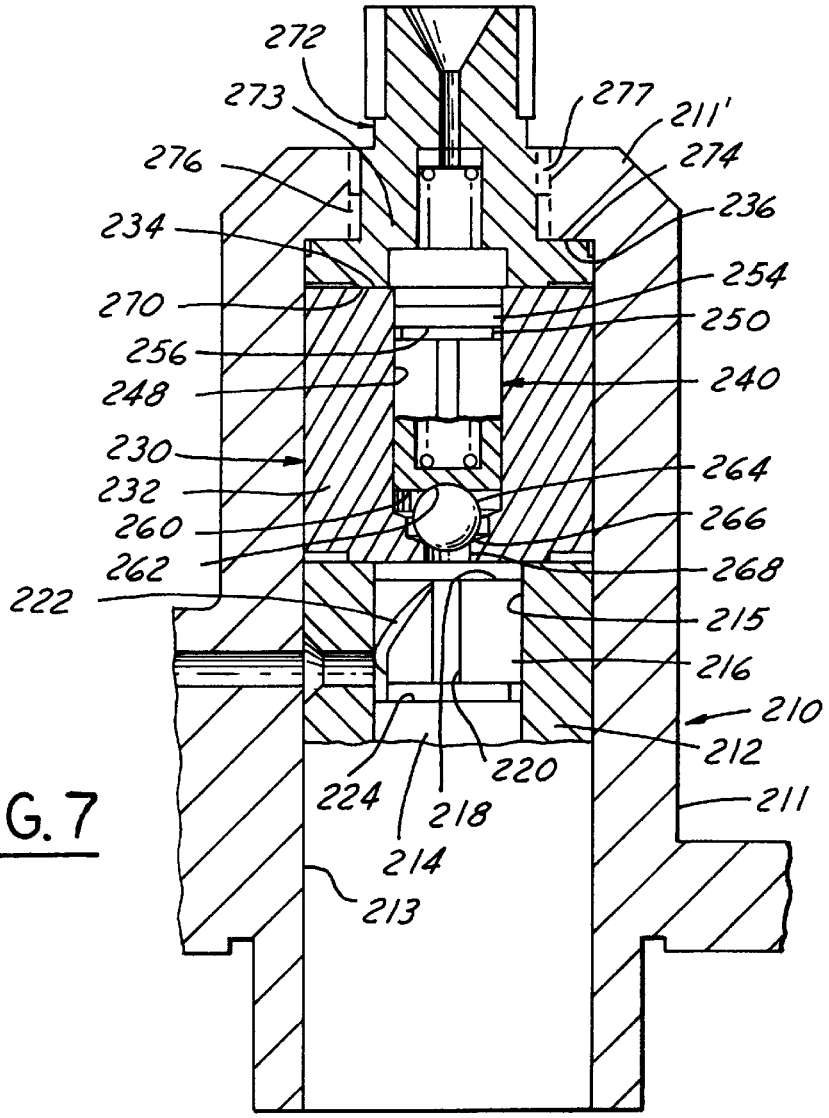
FIG. 7 is an elevational sectioned view of the subject delivery valve in accordance with the present invention.
Figure 8:
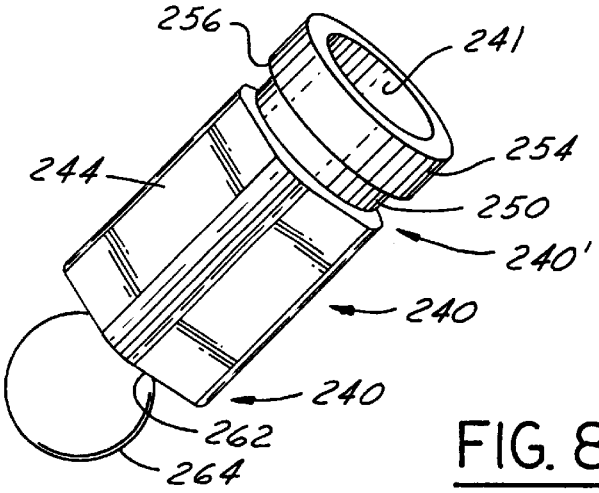
FIG. 8 is a perspective view of the subject valve stem shown in FIG. 7.

An improved fuel pump and delivery valve assembly 210 is illustrated in FIGS. 7 and 8 and includes a casing or housing 211 having an internal bore 213. A barrel member 212 is supported in the internal bore 213. A plunger member 214 is supported in the internal bore 215 of the barrel 212 and is capable of reciprocal movements in the cylinder bore 215 in response to timed inputs from the tappet and camshaft input drive. The upper portion 216 of the plunger 214 is similar in configuration to the plungers in the earlier described pumps and includes: an upper control surface 218; an axially extending groove 220; helically extending control edge 222; a circular groove 224; and a guide extension portion 126 of the plunger.

A delivery valve assembly 230 including a housing 232 is supported within pump housing 211 above the barrel member 212. An upper end surface 234 of the delivery valve housing 232 is seated against a lower surface 270 formed in a lower portion of an outlet fitting 272. Adjacent a reduced diameter portion 273, the outlet fitting 272 has a shoulder 274 seated against a bottom edge portion or shoulder 236 of the housing 211. The outlet fitting 272 is secured against rotation in the pump housing by interaction between splines 276 formed in the outlet fitting 272 and splines 277 formed in the upper portion 211' of the pump casing 211.

The delivery valve housing 232 supports an elongated stem valve member 240 in a bore 248 of the housing 232. The stem valve member 240 has a generally hollow configuration with a central bore 241 extending axially through part of its length. The stem's hollow construction reduces its weight and also provides a space to house much of the spring 168.

Like the second prior art embodiment shown in FIGS. 4–6, a plurality of milled flat portions 144 are formed on the stem 240 instead of the fluted formation found in FIGS. 1–3. A single circumferentially extending groove 250 is formed in the upper end portion 24' of the stem 240. This defines a cylindrical retraction volume land 254 positioned above the groove. The retraction land 254 establishes a lower control edge portion 256.

The lower end surface 260 of the lower portion 240" of the stem member 240 is formed with a slight concavity formation 262 as best seen in FIG. 7. The concavity 262 accurately positions a low-cost precision ball 264 relative to the stem's central axis. In the preferred embodiment, the ball 264 is made of steel partially because such balls are readily available from the ball bearing industry and are made in numbers in the millions. Accordingly, they are high precision and relatively inexpensive. They also are hard and not subject to wear. With this design, the precision, consistency and finish of the low-cost commercially-available balls are always superior to those possible to achieve by machining the conical valve and necked-down section as described above. By using the ball 264 instead of a machined stem member, considerable machining cost is avoided and material costs are also reduced.

In the delivery valve, the ball 264 acts as a check valve when it seats against an edge seat 266 as defined by an apertured lower end portion 268 of the delivery valve housing 232. It is contemplated that the ball 264 could also be made of ceramic material instead of steel. Using ceramic material would reduce the mass of the reciprocating unit considerably and therefore improve the dynamic characteristics of the delivery device and could enable the reduction of the spring rate or the length of the spring, both being desirable.

A Second Improved Embodiment

In FIGS. 9 and 10, a second embodiment of the improved pump and delivery valve is shown whereas the pump and outlet portion of this embodiment is the same as in FIGS. 7–8. Furthermore, the delivery valve 330 utilizes a ball 364 for the check valve as in the previous embodiment. This second embodiment provides a retraction-volume function, as follows: a delivery valve stem member 340 defines a hollow cylindrical central bore 341 as like stem member 240 in the first embodiment. However, unlike stem 240, a retraction volume control such as groove 250, land 254, and edge 256 as in the previous embodiment is eliminated, thus eliminating considerable machining. As in FIGS. 7–8, the flat-milled sections 344 are created and continue upward toward the top end portion 360 of stem 340. The check ball 364 is centered by concavity 390 formed in the lower end extension 340" of the stem 340. The concavity 390 serves to align the ball centrally with respect to the stem.

During the dwell period of injection, the ball 364 seats in an aperture 335 formed in the bottom of the delivery-valve housing 332. This aperture 335 is smaller in diameter than the diameter of the ball 364 to allow the ball to be slidably disposed in a larger aperture 364' within which it fits with a close clearance. When the plunger 314 is reciprocated during a pumping stroke cycle, the ball 364 and valve stem 340 are lifted so that the diameter of the ball 364 is above the upper edge 364" of the aperture 364'. This opens up a clearance space for fuel to flow through. After the plunger 314 completes a pumping portion of the cycle and moves downward from its uppermost position in the bore 315 of the barrel 312, the ball 364 and valve stem 340 start a downward descent. Initiation of the retraction volume occurs as the diameter of the ball check valve 364 registers with the upper edge 364" of the aperture 364'. The delivery valve's total retraction volume is then defined by the diameter of the ball 364 and the distance that the ball travels between the upper edge 364" of the hole 364' and the ball's seated fully downward position. As the ball 364 seats against the edge of aperture 335, the period during which the retraction function occurs ends as the backflow-check function is established by seating of the check valve. The benefits of this design are that it simplifies the machining of the valve stem, makes for a very-light stem member, provides a better finish and more accurately forms a valve than the conically configured surface as in previous designs. Further, to achieve different retraction volumes for different engine requirements, the effective length of the valve stem extension 340", and the length of the aperture 364' can be readily modified.

A Third Improved Embodiment

In FIG. 11, a third embodiment or modification of the delivery valve is illustrated. Specifically, a valve stem 440 should represent a less expensive alternative to the stem 330 shown in FIGS. 9 and 10. Stem 440 eliminates the flats previously machined on the outside diameter of the stem member. Instead, the outside diameter is cylindrical and without flutes. Fuel transfer past the stem is by a plurality of holes or passages 444 drilled or otherwise formed in a conically configured lower surface 445 of the stem member 440. As before, the ball 464 is seated and centered by a concavity 490 in an extension 440". In this fashion, a very-simple, low mass valve is accomplished, with a minimum of machining required. Resultantly, this embodiment should provide an optimum performance at low-cost. This type of simple stem is also a good candidate for ceramics, because of its simple machining and light-weight.

Various changes and modifications can be made to the apparatus described above without departing from the spirit of the invention. Such changes and modifications are contemplated by the inventor and he does not wish to be limited except by the scope of the appended claims.

What is claimed is as follows:

1. For an internal combustion engine with a fuel injection system including a plunger type injection pump supplying pressurized fuel to a fuel injector at an engine cylinder through a high pressure line, an improved delivery valve assembly between the pump and the high pressure line, comprising: a delivery valve housing having a cylinder bore formed therein; an elongated stem member within said cylinder bore supported to permit reciprocal movements therein in response to timed inputs from the internal combustion engine; said delivery valve housing having an apertured end portion between one end portion of said stem member and the pump to form an inlet passage; a valve seat formed about the inlet passage and adjacent to said one end portion of said stem member; a spherically shaped ball located adjacent to said one end portion of said stem member wherein in a closed operative position said ball is urged by said stem member to seat against said valve seat to close said inlet passage thereby inhibiting backflow of fuel to the pump, said housing having an enlarged diameter continuation of said inlet passage leading from said valve seat and opening to a space adjacent said one end portion of said stem member; said enlarged diameter continuation being precisely dimensioned and providing said enlarged diameter continuation with a depth approximately equal to the diameter of said ball so as to permit said ball to closely fit for axial movement therein whereby during a pumping cycle said ball moves away from said valve seat a distance equal to approximately one half the diameter of said ball prior to providing a clearance for pressurized fuel to flow to said space and after completing the pumping cycle said ball moves axially towards said valve seat the same distance as during the pumping cycle to initiate the retraction volume to decrease fuel pressure in said high pressure line.

2. The delivery valve set forth in claim 1 in which said stem has a hollow central portion and an opened second end portion; a stem return spring partially within said central portion for biasing said stem against said ball to urge it into a seated closed operative position with respect to said valve seat.

3. The delivery valve as set forth in claim 1 in which said stem is configured to form fuel passage means between itself and said cylinder of said housing.

4. The delivery valve as set forth in claim 1 in which said one end portion of said stem member is formed with a concavity formation to center said ball with respect to said stem's centerline.

5. The delivery valve as set forth in claim 1 in which said stem member has an axially extending reduced diameter portion extending from said one end portion; said extension having a concavity to center said ball and space said ball a desired distance from the main body portion of said stem member thus adjusting the retraction volume.

6. The delivery valve of claim 5 wherein said main body portion of said stem member is cylindrical in configuration for surface to surface contact with said cylindrical bore and said main body portion is provided with a conically configured lower surface above said extension, said conically configured surface having a plurality of holes formed therein for allowing fuel transfer past said stem member.

* * * * *